US008406670B2

(12) United States Patent
Izawa et al.

(10) Patent No.: US 8,406,670 B2
(45) Date of Patent: Mar. 26, 2013

(54) TONER FIXING APPARATUS AND ELECTROPHOTOGRAPHIC PRINTING DEVICE

(75) Inventors: Hideo Izawa, Sakura (JP); Junichi Setoyama, Yachimata (JP); Kouichi Ooyama, Daisen (JP); Kotaro Harada, Ichikawa (JP)

(73) Assignee: Miyakoshi Printing Machinery Co., Ltd. (JP)

( * ) Notice: Subject to any disclaimer, the term of this patent is extended or adjusted under 35 U.S.C. 154(b) by 524 days.

(21) Appl. No.: 12/572,414

(22) Filed: Oct. 2, 2009

(65) Prior Publication Data

US 2010/0086336 A1 Apr. 8, 2010

(30) Foreign Application Priority Data

Oct. 3, 2008 (JP) ..... 2008-258818

(51) Int. Cl.
*G03G 15/20* (2006.01)
*G03G 13/20* (2006.01)

(52) U.S. Cl. ..... 399/336; 399/69; 399/329; 430/117.5

(58) Field of Classification Search ..... 399/67–70, 399/320, 328, 329, 335, 336; 130/117.5, 130/117.3
See application file for complete search history.

(56) References Cited

U.S. PATENT DOCUMENTS 4,384,783 A * 5/1983 Sakata et al. ..... 399/156
4,462,675 A 7/1984 Moraw et al.
4,766,462 A 8/1988 Dyer et al.
6,148,169 A * 11/2000 Tsukamoto ..... 399/328
2002/0145760 A1 10/2002 Ciaschi et al.
2005/0047836 A1 3/2005 Kellie et al.
2008/0176160 A1* 7/2008 Deprez et al. ..... 430/109.31
2008/0193174 A1 8/2008 Condello et al.

FOREIGN PATENT DOCUMENTS

CN 1591215 A 3/2005
EP 1248162 A2 10/2002
EP 1248162 A3 3/2006
EP 2081088 A1 7/2009

(Continued)

OTHER PUBLICATIONS

European Search Report for European Application No. 09171706.6-2209/2172814 dated Oct. 26, 2010.

(Continued)

*Primary Examiner* — Walter L Lindsay, Jr.
*Assistant Examiner* — Jessica L Eley
(74) *Attorney, Agent, or Firm* — Cantor Colburn LLP

(57) ABSTRACT

A toner fixing apparatus characterized by provision of a provisional fixing portion provided with a provisional fixing component having an infrared heater irradiating infrared radiation onto a printed surface of the web and a main fixing portion provided downstream in the web flow in the provisional fixing portion and nipping the web with heat rollers performing a main fixing operation or having a plurality of main fixing units. According to this invention, a toner fixing apparatus and an electrophotographic printing device including the toner fixing apparatus are provided which display excellent fixing properties during multicolor image formation, excellent heating efficiency and excellent economy with respect to installation space.

6 Claims, 3 Drawing Sheets

FOREIGN PATENT DOCUMENTS

| | | | |
|---|---|---|---|
| JP | 57-128371 | A | 8/1982 |
| JP | 63-030879 | A | 2/1988 |
| JP | 2-51353 | U | 4/1990 |
| JP | 5-241460 | A | 9/1993 |
| JP | 2003-98864 | A | 4/2003 |
| JP | 2003-233268 | A | 8/2003 |
| JP | 2003-248395 | A | 9/2003 |
| JP | 2007-11142 | A | 1/2007 |

OTHER PUBLICATIONS

Search Report for Chinese Application No. 200910221403.8, dated Jun. 28, 2012, with English translation.

Notice of Reasons for Rejection for Japanese Patent Application No. 2008-258818, mailed Nov. 13, 2012, with English translation.

Notice of Reasons for Rejection for Japanese Application Number. 2008-258818, mailed Jan. 8, 2013, with English translation.

* cited by examiner

TONER FIXING APPARATUS AND ELECTROPHOTOGRAPHIC PRINTING DEVICE

BACKGROUND OF THE INVENTION

1. Field of the Invention

The present invention relates to a toner fixing apparatus for a wet-type electrophotographic printing device using a developing liquid composed of a liquid toner and a carrier liquid, and to an electrophotographic printing device provided with the toner fixing apparatus. The present application claims priority from Japanese Patent Application No. 2008-258818, filed Oct. 3, 2008, the content of which is incorporated herein by reference.

2. Description of the Related Art

In an imaging system using a developing liquid composed of a liquid toner (hereafter "toner") and a carrier liquid, the carrier liquid is absorbed by paper when transferring a toner image transcribed onto an intermediate transfer body onto the paper. When the paper passes through a plurality of units provided with an intermediate transfer body to form a multicolored image, the paper contains several color components and a large amount of carrier liquid (for example refer to Japanese Patent Application Laid-Open No. 2007-11142). Consequently a large amount of carrier liquid must be dried and removed from the paper in order to fix the toner. A conventional heated roller method is known as a technique of fixing toner by drying and removing carrier liquid absorbed by paper. However this method has limitations resulting from the contact time and the contact temperature with the printed surface. In view of the above, a non-contact hot-air fixing apparatus has been proposed (for example, refer to Japanese Utility Model Application Laid-Open No. 2-51353). According to this hot-air fixing device, it is possible to ensure the maintenance of a long contact time of hot air with the paper easily by forming the fixing device along the length of the displacement route of the paper. In addition, according to this hot-air fixing device, it is possible to increase the contact temperature of the hot-air with the paper by increasing the hot-air temperature.

However, the non-contact hot-air fixing device above-mentioned has the following problems.

(a) The above-mentioned non-contact hot-air fixing device places the heated air in contact with the paper by discharging heated air from a plurality of through holes provided in a plate-shaped heater body. However an increase in the contact area of the heated air for the paper and elongation of the device to ensure contact time has an adverse effect on the performance of air discharge from through holes in proximity to a central portion of the heated air blow region (region connected with the heater body). Thereby, the heating efficiency is reduced due to the absence of heated air circulation and contamination results from delay of vapor components in residual toner.

(b) When the temperature of heated air is increased to improve fixing properties, stretching or creasing of the paper results from excess heat and affects paper transfer.

(c) The length of the fixing apparatus is increased proportional to the number of colors and results in an increase in the overall size of the apparatus and consequently causes problems associated with installation space.

SUMMARY OF THE INVENTION

The present invention is proposed in view of the above problems and has the object of providing a toner fixing apparatus displaying excellent performance in particular with respect to fixing properties during multicolored image formation in addition to excellent economy of space and heating efficiency and to an electrophotographic printing device provided with the toner fixing apparatus.

The present invention is provided with the following structure in order to solve the above problems. A first aspect of the present invention provides a toner fixing apparatus for a wet-type electrophotographic printing device using a developing liquid composed of a liquid toner and a carrier liquid. This apparatus includes a provisional fixing portion provided with a provisional fixing component having an infrared heater irradiating infrared radiation on a printed surface of a web transferred by the electrophotographic printing apparatus, and a main fixing portion provided downstream of the web flow of the provisional fixing portion and having one or a plurality of main fixing units to nip the web using a plurality of rollers provided with a heat roller. A second aspect of the present invention provides the toner fixing apparatus according to the first aspect further including an air flow formation apparatus forming an air flow along the web to discharge the carrier liquid vaporized from the web by irradiation with infrared radiation from the infrared heater of the provisional fixing component. A third aspect of the present invention provides the toner fixing apparatus according to the second aspect formed the web which extends in a vertical direction, an upstream end of web flow forms an upper end and a downstream end of web flow forms a lower end with respect to the longitudinal direction of the provisional fixing region for irradiating infrared radiation from the infrared heater of the provisional fixing component, the air-blower which forms an air flow along the provisional fixing region by blowing air upwardly from a lower side of the provisional fixing region and/or a blower which positioned upstream of the provisional fixing region and forms the air flow along the provisional fixing region by air aspiration. A fourth aspect of the present invention provides a toner fixing apparatus according to the second or third aspect in which a heat shielding plate is provided through the web extending along the web in a direction opposite to the provisional fixing component, the web passes in a provisional fixing processing space maintained between the heat shielding plate and the provisional fixing component, and the air flow formation apparatus forms an air flow along the web in the provisional fixing processing space. A fifth aspect of the present invention provides a toner fixing apparatus according to any one of the first to the fourth aspects in which the provisional fixing component mounts the infrared heater and the blower fan for blowing air onto the printed surface of the web at the provisional fixing component main body provided along the web. A sixth aspect of the present invention provides a toner fixing apparatus according to any one of the first to the fifth aspects in which the heat roller houses the infrared heater. A seventh aspect of the present invention provides a toner fixing apparatus according any one of the first to the fifth aspects in which the infrared heater outputs infrared radiation having a maximum energy wavelength of 1.2-2.5 μm. An eighth aspect of the present invention provides an electrophotographic printing device which is a wet-type electrophotographic printing device using a developing liquid composed of a liquid toner and a carrier liquid and which includes the toner fixing device according to any one of the first to the seventh aspects and an electrophotographic printing unit performing a printing operation on the web.

According to the present invention, the drying and removal (drying by vaporization of volatile components) of carrier liquid by irradiation with infrared radiation to the web in the provisional fixing portion is performed using frictional heat resulting from internal vibrations within the carrier liquid resulting from the optical energy of infrared radiation from a heat source mainly used for toner fixing operations. As the application of a heating method which applies heat to fix toner by internal vibration of the carrier liquid as a result of optical energy, it is possible to avoid the disadvantages that the residence of heated air involves heating efficiency (reduction in heating efficiency) (for example, refer to Japanese Patent Application Laid-Open No. 2-51353). Drying and removal of carrier liquid by irradiation of the web with infrared radiation is a heating method which applies heat directly to the carrier liquid using infrared optical energy. Consequently drying and removal of carrier liquid (vaporization removal) can be realized in a short time in comparison with drying and removal by application of heated air. Since the provisional fixing portion enables efficient performance of drying and removal of a carrier liquid, downsizing of the device is realized easily, the toner fixing apparatus and electrophotographic printing device can be downsized for more effective use of space. The occurrence of paper creasing and stretching is suppressed in comparison with vaporization removal of carrier liquid by application of high temperature heated air and has the advantage that smooth paper transfer can be maintained. Furthermore, application of a heating method using infrared radiation causes the heated object to reach a target temperature in a short time and therefore enables highly efficient operation. Thereby, damage to paper can be reduced by application of this type of short-term heat application. Furthermore, easy management of the fixing apparatus and improvement of control operation performance are enabled in comparison to drying and removal by application of heated air in accordance with a conventional method. Consequently production efficiency can be improved by better production management. Since fixing operations are performed by a two-step process including provisional fixing by irradiation with infrared radiation in a provisional fixing portion (provisional fixing by vaporization drying of the carrier liquid) and main fixing by application of heat and pressure using a heat roller in a main fixing portion, damage to the recording medium (web) caused by rapid application of pressure and heat can be suppressed in comparison with a one-step fixing operation of heat and pressure without performing a provisional fixing operation. Consequently good drying and fixing and printing quality can be ensured even during high-speed processing. Disadvantages related to the effect of web damage on transfer performance can be avoided and smooth paper transfer can be maintained.

When air flow along the web is formed by the air flow formation apparatus according to the second aspect in order to discharge carrier-liquid vapor vaporized from the web, a further reduction in time for drying by vaporization of the carrier liquid can be realized. In addition, further suppression of paper creasing and stretching of paper can be ensured. Since residence of vapor components from residual toner or vaporized carrier liquid is prevented and vapor discharge is performed in a smooth manner, environmental contamination can be effectively prevented. Furthermore, the effect on peripheral environmental areas and equipment due to residence of vapor components can be prevented.

DETAILED DESCRIPTION OF THE PREFERRED EMBODIMENTS

Figure 1:
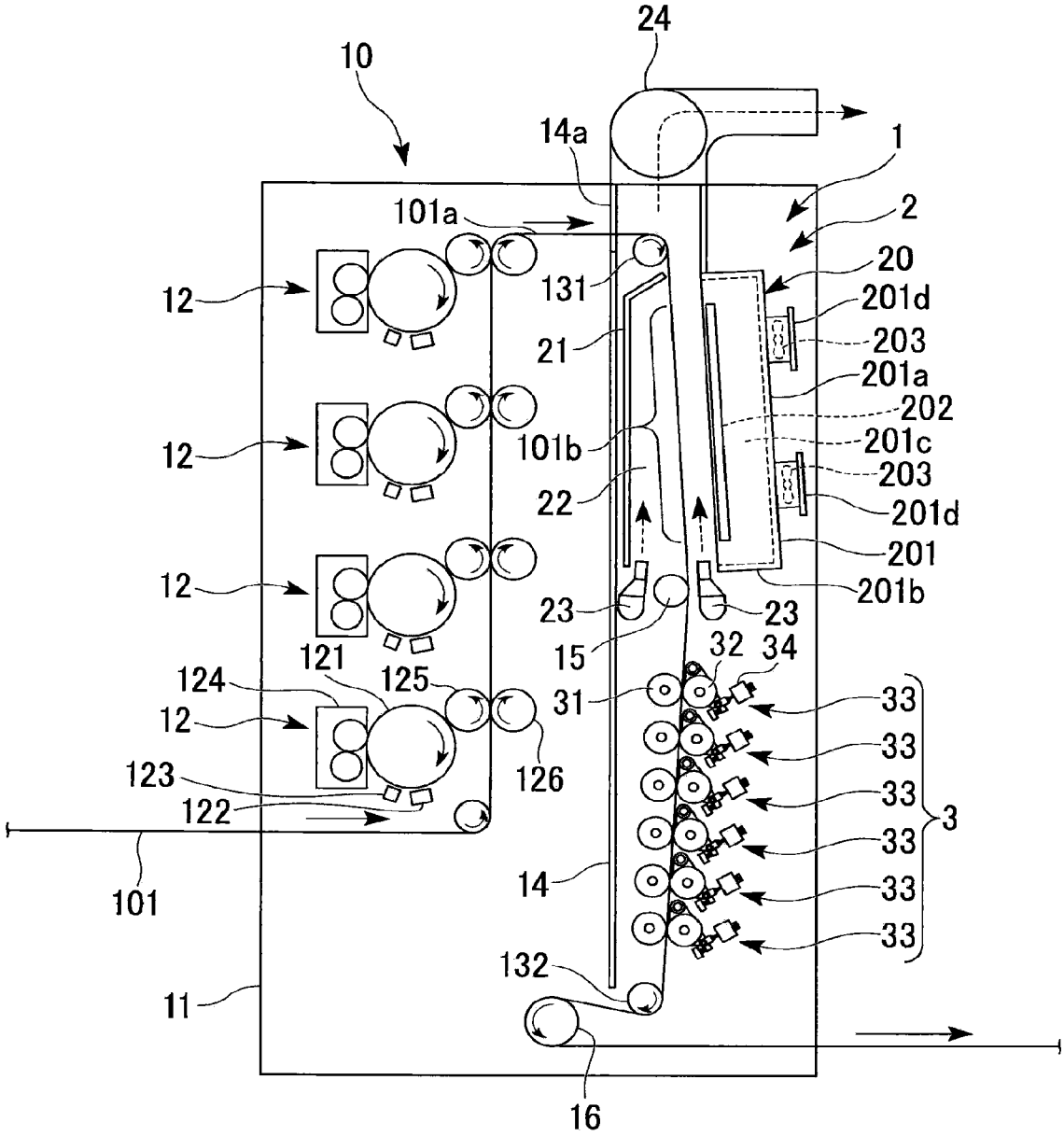
FIG. 1 is a front view showing a first embodiment of an electrophotographic printing device applying a toner fixing apparatus according to the present invention.
Figure 2:
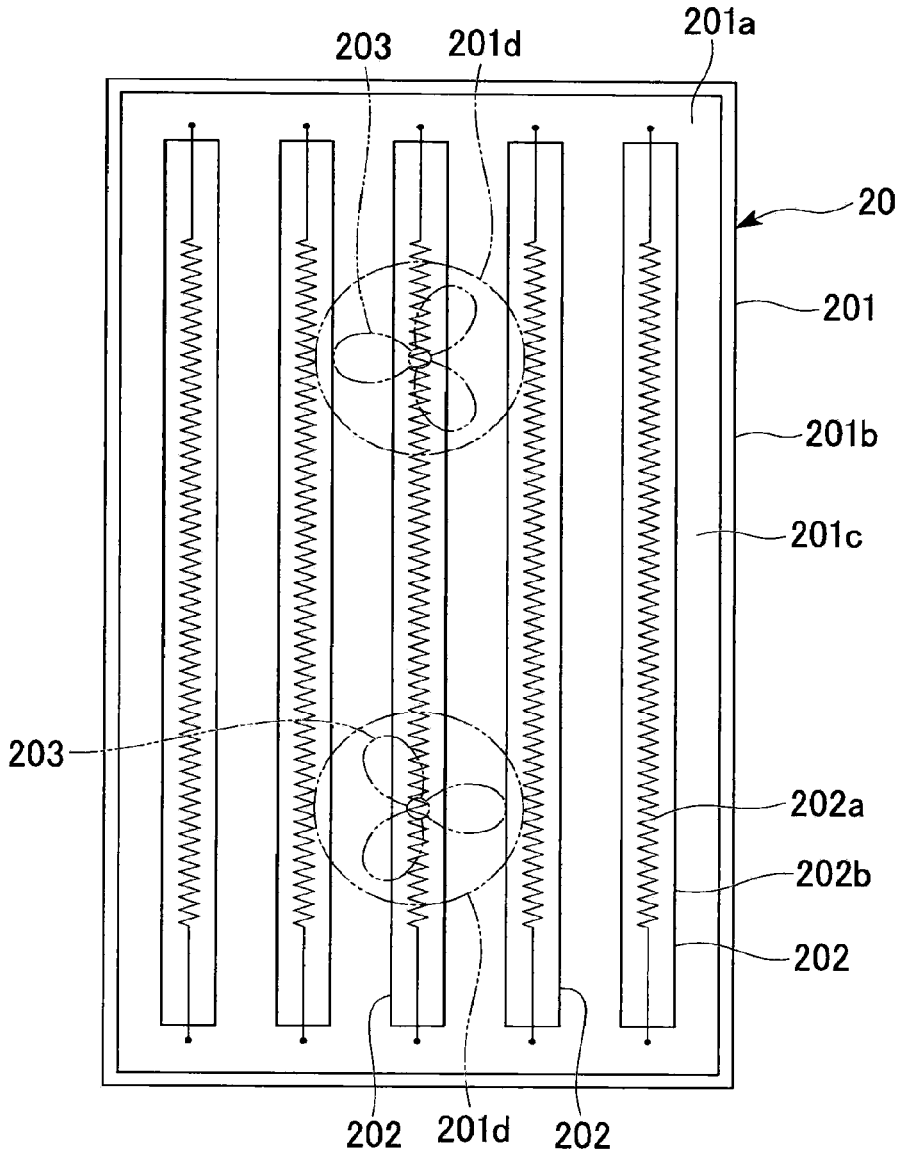
FIG. 2 shows the arrangement of the provisional fixing component of the toner fixing apparatus seen from an open side.
Figure 3:
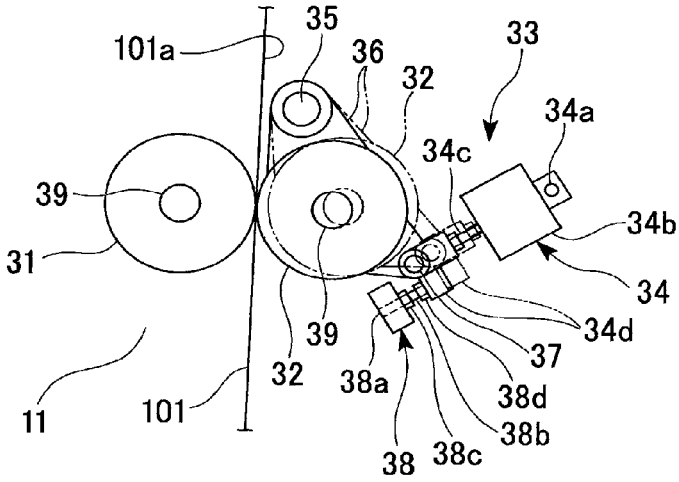
FIG. 3 shows the arrangement of a main fixing unit of a main fixing portion of the toner fixing apparatus.
Figure 4:
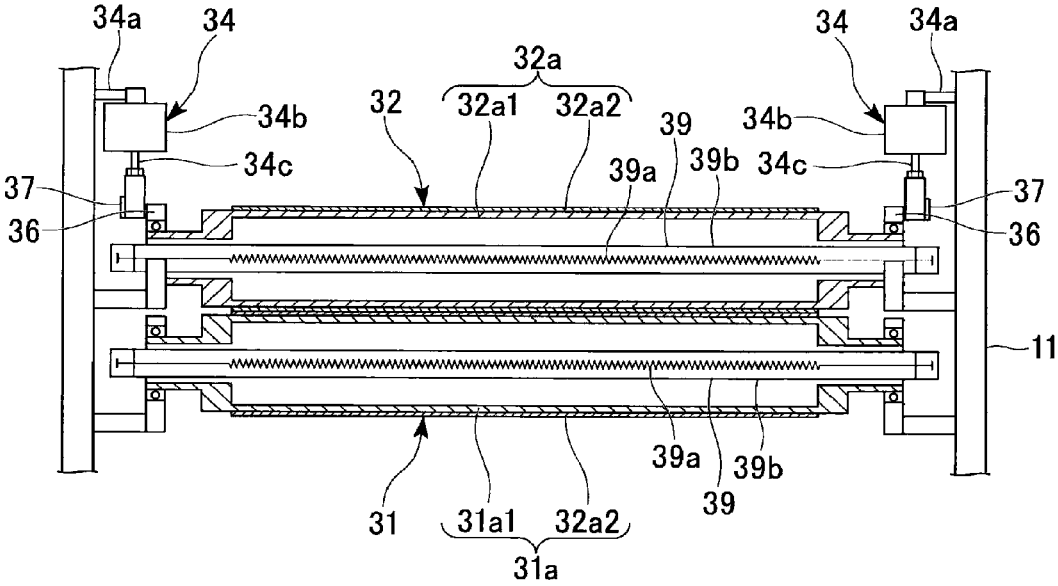
FIG. 4 is a sectional view showing the structure of a main fixing unit as shown in FIG. 3.

The preferred embodiments of a toner fixing apparatus and electrophotographic printing device according to the present invention will be described hereafter making reference to the figures. FIG. 1 is a front view showing an electrophotographic printing device 10 applying a toner fixing apparatus 1 according to the present invention. FIG. 2 shows the arrangement of the provisional fixing components 20 of the toner fixing apparatus 1 seen from an open side. FIG. 3 shows the arrangement of a main fixing unit 33 of a main fixing portion 3 of a toner fixing apparatus 1. FIG. 4 is a sectional view showing the structure of the main fixing unit 33 as shown in FIG. 3. In FIG. 1 to FIG. 4, an upper side will be described as upper and a lower side will be described as lower.

The electrophotographic printing device 10 shown in FIG. 1 is provided with an electrophotographic printing unit 12 provided on upper and lower multiple stages (in the figure, 4 stages are shown) to perform multicolored printing operations, and a toner fixing apparatus 1 fixing toner by drying a web 101 after printing by passing it through the electrophotographic printing unit 12. In FIG. 1, reference number 11 denotes a frame of the electrophotographic printing device 10 and reference number 14 is a partition wall.

The partition wall 14 extends vertically in the frame 11 and is interposed between the toner fixing apparatus 1 and the electrophotographic printing unit 12 in the upper and lower multiple stages. The toner fixing apparatus 1 is provided opposite the electrophotographic printing unit 12 in the upper and lower multiple stages through the partition wall 14. The partition wall 14 also has the function of a heat shielding wall for shielding heat and infrared radiation discharged from the infrared heater in the toner fixing apparatus 1 and preventing the heat or infrared radiation from reaching the electrophotographic printing unit 12. As well, a window 14*a* is formed on an upper portion of the partition wall 14 for allowing passage of the web 101 which has been transferred to the toner fixing apparatus 1 from the uppermost stage of the electrophotographic printing unit 12 (the component positioned furthest downstream in the direction of transfer (hereafter flow direction) of the web 101 of the electrophotographic printing unit 12 in the upper and lower multiple stages).

The electrophotographic printing unit 12 is a wet-type electrophotographic printing device using a developing liquid composed of a liquid toner and a carrier liquid. The electrophotographic printing unit 12 is provided with a photosensitive drum 121, a charger 122 uniformly charging the surface of the photosensitive drum 121, an exposure device 123 forming an electrostatic latent image by exposing and removing an electrical load on the surface of the photosensitive drum 121 due to the charger 122, a developer 124 supplying a developing liquid to the photosensitive drum 121 and forming a toner image forming a visual image of the electrostatic latent image on the surface of the photosensitive drum 121, a transfer roller 125 transferring the toner image from the surface of the photosensitive drum 121 to the web 101 by rotating while in contact with the photosensitive drum 121, and a backup roller 126 pressing the web 101 onto the transfer roller 125.

The electrophotographic printing units 12 in the upper and lower multiple stages provided on the electrophotographic printing device 10 each have different printing colors. An elongated band-shaped web 101 is colored in a plurality of colors by being passed in sequence through the upper and lower multiple stages of the electrophotographic printing unit 12, and by being transferred in a longitudinal direction to the electrophotographic printing device 10 (in the example shown in the figure, the direction of transfer is from a lower direction to an upper direction of the lowest stage of the electrophotographic printing unit 12).

In the electrophotographic printing units 12 in the upper and lower multiple stages, the web 101 which is transferred from the electrophotographic printing unit 12 (in the example shown in the figure, the electrophotographic printing unit 12 in the uppermost stage) and which is positioned furthest downstream with respect to the direction of transfer of the web 101 is guided by rollers 131, 132 which are provided at an interval in an upper and lower position in the electrophotographic printing device 10, in a direction (in the example shown in the figure, from the upper roller 131 downwardly) opposite the portion passing through the electrophotographic printing unit 12 in the upper and lower multiple stages. The toner is fixed by a toner fixing apparatus 1 provided between the upper and lower rollers 131, 132. Additionally, in the figure, a reference number 15 denotes a tension roller applying a tensile force to the web 101 between the upper and lower rollers 131, 132, a reference numeral 16 denotes a tension roller applying a tensile force to the web 101 transferred from the lower roller 132 in a downstream transfer direction.

The toner fixing device 1 will be described next. As shown in FIG. 1, in the electrophotographic printing device 10, the toner fixing apparatus 1 is provided with a provisional fixing portion 2 including a provisional fixing component 20 irradiating infrared radiation on a printed surface 101*a* of a portion of the web 101 provided in a tensioned state between upper and lower rollers 131, 132, and a main fixing portion 3 provided downstream of the web flow of the provisional fixing portion 2 (the lower side of the provisional fixing portion 2 in FIG. 1).

The provisional fixing portion 2 includes a provisional fixing component 20, a heat shielding plate 21 extending along the web 101 in a direction opposite to the provisional fixing component 20 through the portion of the web 101 provided in a tensioned state between upper and lower rollers 131, 132, and an air-blower 23 and a blower 24 for forming an air flow along the web 101 in a provisional processing space 22 provided between the heat shielding plate 21 and the provisional fixing component 20. In the provisional processing space 22, the web 101 passes through and extends in a vertical direction. The provisional fixing component 20 and the heat shielding plate 21 which are opposed through the provisional processing space 22 are provided at an interval from the portion of web 101 which passes through the provisional processing space 22 in order to not make contact with the web 101.

The provisional fixing component 20 mounts an infrared heater 202 and a blower fan 203 for blowing air onto the printed surface 101*a* of the web 101 on the provisional fixing component main body 201 provided along the web 101. As shown in FIG. 1 and FIG. 2, the provisional fixing component main body 201 is provided with a back plate portion 201*a*, and a box-shaped side wall portion 201*b* projecting to one side of the back plate portion 201*a* from an outer peripheral portion of the back plate portion 201*a* and is formed in the shape of a concave cover housing the infrared heater 202 on an inner side of the side wall portion 201*b*.

The appearance of the infrared heater 202 is rod-shaped and the longitudinal dimension of the heater 202 is aligned along the flow direction of the web 101. A plurality of heaters is aligned in a row on an inner side of the main body 201 of the provisional fixing component. The plurality of infrared heaters 202 is aligned horizontally on an inner face substantially parallel with the printed face 101*a* of the web 101 passing through the provisional fixing processing space 22. There is no particular limitation on the number of infrared heaters 202. There is no requirement for the infrared heaters 202 to be longitudinally arranged along the direction of flow of the web 101 and, for example, the heaters 202 may be placed in a plurality of upper and lower multiple stages extending in a horizontal direction. In the present invention, there is no particular limitation on the shape of the infrared heaters and the shape is not limited to a bar shape.

The infrared heaters 202 house a filament 202*a* which is heated by a current to emit infrared radiation in an infrared-lucent housing pipe 202*b*. The housing pipe 202*b* is formed from a material displaying excellent infrared-lucent properties such as quartz glass. The filament 202*a* is housed along the entire longitudinal length of the housing pipe 202*b* and is formed from materials such as, for example, cantal line, tungsten and carbon.

The provisional fixing component main body 201 is disposed in a direction in which the opposite side (hereafter "open side") of the back plate portion 201*a* faces the web 101 through the space (heater housing space 201*c*) on an inner side surrounded by the side wall 201*b*. In this manner, in the provisional fixing component 20, the web 101 is irradiated with infrared radiation emitted by the infrared heater 202 from the open side of the provisional fixing component main body 201. The provisional fixing component main body 201 may be arranged so that an inner face of the heater housing space 201*c* is an infrared radiation reflection face by mounting a reflection plate for reflecting infrared radiation. The provisional fixing component main body 201 is formed from a material enabling reflection of infrared radiation and the inner face of the heater housing space 201*c* may also be an infrared radiation reflection face. In this manner, infrared radiation emitted from the infrared heater 202 is irradiated onto the web 101 without waste.

The blower fan 203 is assembled in an air inlet port 201*d* provided in the back plate portion 201*a* of the provisional fixing component main body 201. The blower fan 203 performs blowing operations to draw external air from outside the provisional fixing component main body 201 into the provisional fixing component main body 201 and blow the air onto the web 101. The air blown by the blower fan 203 is used for drying and removal (removal by vaporization) of carrier liquid absorbed by the web 101 and in addition, is useful in preventing overheating of the provisional fixing component 20.

The fan 23 and the blower 24 each function as an air flow formation apparatus forming an air flow in the provisional fixing processing space 22 from the lower end of the space in an upward direction and discharging vapor of the carrier liquid being vaporized from the web 101 due to the irradiation with infrared radiation from the infrared heater 202. The air flow discharges carrier liquid (carrier liquid vapor) vaporized from the portion (mainly the region along the entire length of the infrared heater 202 of the provisional fixing component 20 with respect to a longitudinal direction of the web 101 (hereafter referred to as the provisional fixing region 101*b*)) of the web 101 passing through the provisional fixing processing space 22 from the provisional fixing processing space 22.

The fan 23 is disposed on a lower side of the provisional fixing processing space 22 between the heat shielding plate 21 and the provisional fixing component 20 and forms an air flow in an upward direction from a lower end in the provisional fixing processing space 22 by performing blowing operations in an upward direction. In other words, the fan 23 forms an air flow in the provisional fixing processing space 22 rising along the web 101 passing through the provisional fixing processing space 22. The fan 23 is disposed respectively on both sides of the web 101 (both sides through the web 101 along the dimension of thickness of the web 101). The web 101 passes between a pair of fans 23 disposed with an interval on a lower side of the provisional fixing processing space 22.

The blower 24 is disposed on an upper end of the provisional fixing processing space 22 and draws in and discharges air in the provisional fixing processing space 22 to form an air flow in the provisional fixing processing space 22 in an upward direction from a lower end of the provisional fixing processing space 22.

The toner fixing apparatus and electrophotographic printing device according to the present invention are not limited to an arrangement of using both a fan 23 and a blower 24 as an air flow formation apparatus in an upward direction from a lower end of the provisional fixing processing space 22, and only one of the fan 23 or the blower 24 may be used. The temperature of the air (in the example shown in the figure, the air transferred to the provisional fixing processing space 22 by the fan 23) introduced by the air flow formation apparatus into the provisional fixing processing space 22 to form an air flow in the provisional fixing processing space 22 is preferably 10-40° C. Although an actual example of an air flow formation apparatus will be described with respect to an arrangement of forming an air flow which rises in the provisional fixing processing space 22, the air flow formation apparatus is not limited thereto. The air flow formation apparatus may form an air flow in a direction along the web 101 (along the face of the web 101) in the provisional fixing processing space 22, or for example, it may form an air flow descending in the provisional fixing processing space 22 or an air flow in a horizontal direction. However, as shown above, an air flow formed to rise in the provisional fixing processing space 22 has the advantage of enabling smooth discharge from the provisional fixing processing space 22 of carrier liquid vapor (the vapor rising upwardly from the provisional fixing region 101*b* of the web 101) discharged from the web 101 due to heating by the infrared radiation from the infrared heater 202 of the provisional fixing component 20.

The air flow formed in the provisional fixing processing space 22 by the fan 23 and the blower 24 makes contact with the entire provisional fixing region 101*b* of the web 101 passing through the provisional fixing processing space 22. In this manner, the web 101 which is in a wet state after absorbing a carrier liquid undergoes efficient drying due to the synergistic effect of drying due to the irradiation with infrared radiation from the infrared heater 202 of the provisional fixing component 20 and the drying due to the air flow formed in the provisional fixing processing space 22. As a result, provisional fixing of the toner onto the web 101 can be realized in a short time. Furthermore, the vapor of the carrier liquid vaporized from the web 101 by the irradiation with infrared radiation is smoothly discharged from the provisional fixing processing space 22 by the air flow formed in the provisional fixing processing space 22 by the fan 23 and the blower 24. In this manner, accumulation of carrier liquid vapor in the provisional fixing processing space 22 can be prevented and this arrangement is useful for drying the web 101 in a short time. Furthermore, it is also useful for prevention of contamination resulting from vapor component accumulation in residual toner.

The drying of the web 101 using infrared radiation is performed by vaporizing and drying the carrier liquid by heating the car0rier liquid with friction created by internal vibration in the carrier liquid caused by optical energy as a result of infrared radiation being absorbed by the carrier liquid absorbed by the web 101. If drying is performed using irradiation with infrared radiation, drying of the web 101 and drying and removal of the carrier liquid can be realized efficiently in a short time by heating the carrier liquid absorbed by the web 101 efficiently in a short time in comparison with method heating the web from the web surface by blowing heated air (for example see Japanese Patent Application Laid-Open No. 2-51353). Furthermore as shown above, drying of the web 101 is promoted by the air flow as a result of the air flow formed by the air flow formation apparatus in the provisional fixing processing space 22 coming into contact with the web 101 (in particular the provisional fixing region 101*b*). In this manner, drying of the web 101 can be realized in a short time.

The performance of carrier liquid drying and removal and drying of the web 101 performed in a short time by using infrared radiation to dry the web 101 has the advantage of suppressing irradiation of the web 101 for the drying operation to a low level. In this manner, the occurrence of damage due to paper creasing and stretching as a result of excess heat can be prevented. Furthermore, since irradiation of the web 101 is further reduced by executing the drying operation of the web 101 and the drying and removal operation of the carrier liquid by combination with an air flow formed by the air flow formation apparatus in the provisional fixing processing space 22, further occurrence of damage such as paper creasing and stretching having an adverse effect on the transfer of the web can be prevented. The provisional fixing portion 2 can be downsized by using an arrangement for the provisional fixing portion 2 which performs the drying and removal of carrier liquid and drying of the web 101 in a short time. Consequently the overall size of the toner fixing apparatus and the electrophotographic printing device can be reduced which enables more effective use of space.

The infrared heater 202 preferably outputs infrared radiation with a maximum energy wavelength of 1.2-2.5 μm. The maximum energy wavelength means the wavelength which has the largest energy in the wavelength region of the infrared radiation outputted (emitted) by the infrared heater 202. For this infrared heater 202, preferred examples include a heater having a temperature of the filament 202*a* resulting from application of a current of 1400-2100° C., a maximum energy wavelength of 1.2-1.7 μm and a maximum energy density of 120 kw/m$^2$, and a heater having a temperature of the filament 202*a* resulting from application of a current of 950-1200° C., a maximum energy wavelength of 2.0-2.5 μm and a maximum energy density of 100 kw/m$^2$. These types of infrared heaters are effective for increasing the temperature of a target heated material in a short time. For example, the web 101 can be increased to a temperature enabling drying and removal of carrier liquid in a short time of approximately 1-3 seconds after commencement of irradiation of infrared radiation. Thus this type of infrared heater is effective for reducing the time required for drying and removal of the carrier liquid and drying of the web 101. Furthermore, the occurrence of paper damage is reduced when starting after a printing preparation period or restarting after a temporary stoppage and consequently the efficiency of producing of the printed material can be improved.

In the example shown in the figure of a toner fixing apparatus 1 and an electrophotographic printing device 10, the air blowing by the fan 203 of the provisional fixing component 20 can be used for drying and removal of carrier liquid absorbed in the web 101. The air blowing blown by the fan 203 is heated by being passed through the heater housing space 201*c* on an inner side of the provisional fixing component main body 102 of the provisional fixing component 20 and is performed blowing operations to the web 101 (provisional fixing region 101*b*). The air which is being blown to the web 101 by the fan 23 is impelled by the air flow formed by the air flow formation apparatus in the provisional fixing processing space 22 and is discharged from the provisional fixing processing space 22.

Next, the main fixing portion 3 will be described. As shown in FIG. 1, the main fixing portion 3 mounts main fixing units 33 which nip the web 101 using a pair of heatrollers 31,32 used in the main fixing operation at upper and lower multiple stages (the six stages in FIG. 1). The heat rollers 31, 32 are housed in the infrared heater 39 and are heated by the infrared heater 39.

As shown in FIG. 1 and FIG. 3, the main fixing unit 33 includes a fixing side roller 31 which is a heat roller 31 fixed to the frame 11, a pressing roller 32 which is a heat roller 32 pressing the web 101 onto the fixing roller 31 and a pressing mechanism 34 for pressing the pressing roller 32 onto the fixing roller 31. As shown in FIG. 3 and FIG. 4, in the main fixing unit 33 shown in the figure, both ends in the axial direction of the pressing roller 32 are axially supported to freely rotate on a bracket 36 mounted to freely rotate on a rotation shaft 35 mounted in the frame 11, and can rotate about the rotation shaft 35 integrated with the bracket 36. The pressing mechanism 34 is more precisely a drive cylinder apparatus (hereafter when the pressing mechanism refers to the drive cylinder apparatus, the pressing mechanism will be referred to as a "drive cylinder device"). The tip of a piston shaft 34*c* projects from a cylinder main body 34*b* connected by a pin (pin connection unit 34*a*) with the frame 11. The tip is connected to rotate freely on the bracket 36 through a pin 37 and can press the pressing roller 32 towards the fixing side roller 31 due to the projection from the cylinder main body 34*b* of the piston shaft 34*c*. In this manner, the web 101 is nipped by the pair of heat rollers 31, 32.

The main fixing unit 33 of the main fixing portion 3 is provided with a stopper 38 abutting with an abutment piece 34*d* projecting towards the tip of the piston shaft 34*c* of the drive cylinder device 34 when the pressing roller 32 pushes towards the fixing side of the roller 31. The stopper 38 is fixed on the frame 11. The stopper 38 includes a fixed block 38*a* fixed to the frame 11, a bolt 38*b* threadably engaged with the fixed block 38*a* and enabling variation of the projecting dimension from the fixed block 38*a* by a rotational operation, a fixing nut 38*c* fixing the bolt 38*b* to the fixed block 38*a* by threadable attachment and fixing to the bolt 38*b* and a head portion 38*d* formed on the tip of the bolt 38*b* projecting from the fixed block 38*a* and abutting with the abutting piece 34*d* of the tip of the piston shaft 34*c* of the drive cylinder device 34. The main fixing unit 33 can adjust the nip force with which the pair of heat rollers 31, 32 nip the web 101 by varying the projecting dimensions of the bolt 38*b* from the fixed block 38*a* through variation of the position of threadable attachment of the bolt 3 8*b* with the fixed block 38*a*.

The pressing roller 32 can be spaced from the fixing side roller 31 by reducing the projection amount of the piston shaft 34*c* from the cylinder main body 34*b* by drawing the piston shaft 34*c* into the cylinder main body 34*b* from the state (state shown by the solid line in FIG. 3) nipping the web 101 between the pair of heat rollers 31, 32. In this manner, the nipped state of the web 101 between the pair of heat rollers 31, 32 can be released thereby ensuring a distance for facilitating the insertion of the web 101 into or removal of the web 101 from between the pair of heat rollers 31, 32. As shown by the virtual line in FIG. 3, the abutting piece 34*d* on the tip of the piston shaft 34*c* of the drive cylinder device 34 can be spaced from the head portion 38*d* of the bolt 38*b* of the stopper 38. Thus in a state that the abutting piece 34*d* on the tip of the piston shaft 34*c* of the drive cylinder device 34 is isolated from the stopper 38 (more precisely, the distance from the head portion 38*d* of the bolt 38*b*), if the piston shaft 34*c* projects from the cylinder main body 34*b*, the pressing roller 32 approaches the fixed roller 31. The approach of the pressing roller 32 with respect to the fixing side roller 31 is stopped when the abutment piece 34*d* of the tip of the piston shaft 34*c* abuts with the stopper 38 (more precisely, abutment of the bolt 38*b* with the head portion 39*d*).

The displacement (the rotation about the rotation shaft 35) of the pressing roller 32 resulting from projecting and drawing of the piston shaft 34*c* of the drive cylinder device 34 maintains a state in which the axial center of the pressing roller 32 and the axial center of the fixing side roller 31 are parallel. The nipping operation on the web 101 resulting from the pair of heat rollers 31, 32 is performed by sandwiching the web 101 with the pair of heat rollers 31, 32 from both sides with respect to the direction of thickness in the web 101.

As shown in FIG. 3 and FIG. 4, the pressing roller 32 houses the infrared heater 39 in an outer body 32*a* covering an outer peripheral surface of a metal cylinder 32*a*1 with a rubber covering layer 32*a*2. The infrared heater 39 has the same structure as the infrared heater 202 of the provisional fixing component 20. In other words, the heater 39 has a filament 39*a* heated by application of a current to emit infrared rays which is stored in an infrared-penetrability storage pipe 39*b* and has a rod-shaped external appearance. The filament 39*a* can be adapted as the filament 202*a* of the infrared heater 202 of the provisional fixing component 20. The filament 39*a* is stored along the entire length of a longitudinal direction of the storage pipe 39*b*. The infrared heater 39 is disposed on an axial center of the outer body 32*a* of the pressing roller 32 and is provided along the entire length of an axial direction of the outer body 32*a*. The outer body 32*a* of the pressing roller 32 is heated by infrared rays emitted by the filament 32*b* which is heated due to application of current.

The fixing roller 31 of the main fixing unit 33 also has the same structure as the pressing roller 32. In FIG. 3, reference numeral 31*a* denotes the outer body of the fixed roller 31. An outer peripheral surface of a metal cylinder 31*a*1 of the outer body 31*a* is covered by a rubber covering layer 31*a*2. The fixing side roller 31 houses the infrared heater 39 in the outer body 31*a*. In the fixed roller 31, the infrared heater 39 is disposed on an axial center of the outer body 31*a* of the fixed roller 31 and is provided along the entire length of an axial direction of the outer body 31*a*. The outer body 31*a* of the fixing roller 31 is heated by infrared rays emitted by the filament as a result of heating due to application of current.

The main fixing unit 33 ensures attachment of the toner to the web 101 by heat and pressure due to the nipping operation of the web 101 by the pair of heat rollers 31, 32 heated by an infrared heater 39. An arrangement of heating and attaching using a pair of heat rollers 31, 32 ensures good surface properties for the printing surface 101*a* of the web 101. As a result, good attachment is realized which satisfies both requirements for dryness and surface properties in the printing surface 101*a*.

Similar to the infrared heater 202 of the provisional fixing component 20, the infrared heater 39 preferably outputs infrared radiation having a maximum energy wavelength of 1.2-2.5 μm. Preferred examples of the infrared heater 39 include a heater which has a temperature of the filament 39*a* due to application of a current of 1400-2100° C., a maximum energy wavelength of 1.2-1.7 μm and a maximum energy density of 120 kw/m$^2$, and a heater which has a temperature of the filament 39*a* due to application of a current of 950-1200° C., a maximum energy wavelength of 2.0-2.5 μm and a maximum energy density of 100 kw/m$^2$. This type of infrared heater is effective for increasing the temperature of a target heated material in a short time and, for example, the occurrence of paper damage is reduced when starting after a printing preparation period or restarting after a temporary stoppage and consequently the production efficiency of the printed material can be improved. Furthermore, the section of the outer body of the heat rollers 31, 32 having a reduced temperature due to coming into contact with the web 101 can be increased to an initial temperature in a short time by being brought into contact again with the web 101 by rotation of the heat rollers 31, 32 thereby providing effective stabilization of the surface temperature of the heat rollers 31, 32.

As shown in FIG. 1, the main fixing portion 3 is provided with a plurality of main fixing units 33 and performs the main toner fixing operation for the web 101 by heat and pressure from each main fixing unit 33 which is passed through the plurality of main fixing units 33. In case of this composition, it is possible to obtain a fixed stable state without unevenness by setting a number of main fixing units 33 corresponding to the printing speed, a number of electrophotographic printing units 12 in the electrophotographic printing device 10. Further, since heating and pressuring of the web 101 is performed over a plurality of occasions by the plurality of main fixing units 33, a stable fixed state without unevenness can be obtained. In this manner, damage such as paper creasing or stretching occurring in the recording material (web 101) can be suppressed.

According to this toner fixing apparatus 1 and electrophotographic printing device 10, the provisional fixing portion 2 can obtain a stable fixed state without unevenness in response to the printing speed or the provided number of electrophotographic printing units 12 in the electrophotographic printing device 10 with respect to the size (in particular, the dimensions along the direction of flow of the web 101) of the provisional fixing component 20.

According to this toner fixing apparatus 1 and electrophotographic printing device 10, since the provisional fixing portion 2 is provided on an upper side of the main fixing portion 3 which disposes a plurality of main fixing units 33 in upper and lower multiple stages, it is possible to freely assemble with a composition (selection of size of provisional fixing component 20, and/or setting of provided number of main fixing units 33) determined by the printing conditions such as the printing speed or the number of printed colors in a fixed space in a horizontal direction of the printing machine. Consequently, a system can be provided which has no waste in terms of printing quality, production efficiency, installation space, and installation costs, and which has excellent quality and as economical.

The present invention is not limited to the above embodiments and suitable modifications may be made without departing from the spirit of the invention. For example, in the embodiments above, although the toner fixing apparatus 1 and electrophotographic printing device 10 were described as provided with a provisional fixing portion 2 on an upper side of the main fixing portion 3 having an arrangement of providing a plurality of main fixing units 33 on upper and lower multiple stages, the toner fixing apparatus and electrophotographic printing device of the present invention may be provided with a provisional fixing portion having a provisional fixing component performing provisional fixing by irradiation with infrared rays and a main fixing portion performing main fixing of toner by nipping the web with a plurality of rollers containing the heat rollers for performing main fixing. There is no particular limitation on the arrangement described in the embodiments above with respect to the positional relationship of the provisional fixing portion and the main fixing portion, and the installation position and the provided number of main fixing units in the main fixing portion.

In the above embodiments, with respect to the main fixing unit 33, an example of an arrangement in which a main fixing operation was performed by nipping the web using a pair of heat rollers 31, 32 was described. The main fixing unit can also adopt an arrangement of a heat roller and a roller other than a heat roller (and not providing a heat function) as rollers for nipping the web. Furthermore, the heat roller provided on the main fixing portion of the present application is not limited to a composition which includes the infrared heater illustrated in the above embodiment. In the present invention, it is possible to adopt a heat roller which is well known and is used for fixing toner in the wet-type electrophotographic printing device, as this heat roller.

What is claimed is:

1. A toner fixing apparatus for a wet-type electrophotographic printing device using a developing liquid comprised of a liquid toner and a carrier liquid, comprising:

a provisional fixing portion provided with a provisional fixing component having an infrared heater irradiating infrared radiation on a printed surface of a web transferred by the electrophotographic printing apparatus;

a main fixing portion provided downstream in a web flow of the provisional fixing portion and having one or a plurality of main fixing units for nipping the web using a plurality of rollers provided with a heat roller; and an air flow formation apparatus forming an air flow along the web to discharge a vapor of the carrier liquid vaporized from the web by infrared radiation from the infrared heater of the provisional fixing component, wherein the web extends in a vertical direction in such that the provisional fixing region for irradiating infrared radiation from the infrared heater of the provisional fixing component forms an upstream end of web flow is an upper end and a downstream end of web flow is a lower end with respect to the longitudinal direction of the web, and as the air flow formation, a fan forming an air flow along the provisional fixing region by blowing air upwardly from the lower side of the provisional fixing region and/or a blower positioned upstream of the provisional fixing region and to form an air flow along the provisional fixing region by drawing air.

2. The toner fixing apparatus according to claim 1, wherein the provisional fixing component mounts the infrared heater and a blower fan for blowing air onto the printed surface of the web on the provisional fixing component main body provided along the web.

3. The toner fixing apparatus according to claim 1, wherein the heat roller houses an infrared heater.

4. The toner fixing apparatus according to claim 1, wherein the infrared heater outputs infrared radiation having a maximum energy wavelength of 1.2-2.5 μm.

5. A wet-type electrophotographic printing device using a developing liquid composed of a liquid toner and a carrier liquid, the electrophotographic printing device comprising the toner fixing apparatus according to claim 1 and an electrophotographic printing unit performing a printing operation on the web.

6. The toner fixing apparatus according to claim 1, wherein a heat shielding plate is provided through the web and extends along the web in a opposite side of the provisional fixing component, the web is passed through a provisional fixing processing space maintained between the heat shielding plate and the provisional fixing component, and the air flow formation apparatus forms an air flow of a direction along the web in the provisional fixing processing space.

* * * * *